US010294088B2

(12) United States Patent
Cannell et al.

(10) Patent No.: US 10,294,088 B2
(45) Date of Patent: May 21, 2019

(54) MULTI-CABLE SUBSEA LIFTING SYSTEM

(71) Applicant: TECHNIP FRANCE, Courbevoie (FR)

(72) Inventors: David Cannell, Insch Aberdeenshire (GB); Ramesh Babu Kante, Westhill Aberdeenshire (GB); David Fraser, Aberdeen Aberdeenshire (GB)

(73) Assignee: TECHNIP FRANCE (FR)

( * ) Notice: Subject to any disclaimer, the term of this patent is extended or adjusted under 35 U.S.C. 154(b) by 429 days.

(21) Appl. No.: 15/120,718

(22) PCT Filed: Feb. 24, 2015

(86) PCT No.: PCT/IB2015/000494

§ 371 (c)(1),
(2) Date: Aug. 22, 2016

(87) PCT Pub. No.: WO2015/128733

PCT Pub. Date: Sep. 3, 2015

(65) Prior Publication Data

US 2017/0008741 A1 Jan. 12, 2017

(30) Foreign Application Priority Data

Feb. 25, 2014 (GB) ..... 1403298.1

(51) Int. Cl.

| | |
|---|---|
| ***B66D 1/52*** | (2006.01) |
| ***B66C 13/02*** | (2006.01) |
| ***B66D 1/60*** | (2006.01) |

(52) U.S. Cl.

CPC ..... *B66D 1/52* (2013.01); *B66C 13/02* (2013.01); *B66D 1/525* (2013.01); *B66D 1/60* (2013.01);

(Continued)

(58) Field of Classification Search

CPC ..... B66D 1/50; B66D 1/505; B66D 1/52; B66D 1/525; B66D 1/60; B66D 2700/0125; B66D 2700/0108; B66C 13/02

See application file for complete search history.

(56) References Cited

U.S. PATENT DOCUMENTS 3,567,040 A * 3/1971 Thomson ..... B63B 27/04 212/242
3,633,961 A * 1/1972 Speransky ..... B66C 1/34 294/82.15

(Continued)

FOREIGN PATENT DOCUMENTS

EP 0 312 336 4/1989
EP 2447202 A1 5/2012

(Continued)

OTHER PUBLICATIONS

International Search Report dated Aug. 6, 2015 issued in corresponding International patent application No. PCT/IB2015/000494.

(Continued)

*Primary Examiner* — Sang K Kim
*Assistant Examiner* — Nathaniel L Adams
(74) *Attorney, Agent, or Firm* — Ostrolenk Faber LLP

(57) ABSTRACT

A multi-cable subsea lifting system including two or more load-cable lifting apparatus (2*a*, 2*b*); a load cable (4*a*, 4*b*) extending from each load-cable lifting apparatus (2*a*, 2*b*) to a subsea attachment point; a torque measuring device (22) associated with each load cable (4*a*, 4*b*); one or more subsea anti-cabling devices (20), each anti-cabling device (20) including a motor (24) connected to a respective load cable (4*a*, 4*b*); and a controller (30) in communication with each motor (24) and torque measuring device (22); wherein the controller (30) is configured to actuate each motor (24) to impart a rotational force to its respective load cable (4*a*, 4*b*) in response to measurements obtained from the torque (Continued)

measuring device (22) with the aim to limit cabling, remove cabling or control heading either automatically or from external control.

19 Claims, 7 Drawing Sheets

(52) U.S. Cl.
CPC ..... *B66D 2700/0108* (2013.01); *B66D 2700/0125* (2013.01)

(56) References Cited

U.S. PATENT DOCUMENTS

| | | | | |
|---|---|---|---|---|
| 3,851,492 | A | 12/1974 | Cannon et al. | |
| 4,838,522 | A * | 6/1989 | Calkins | B66C 13/02 212/259 |
| 5,507,596 | A * | 4/1996 | Bostelman | B63B 38/00 166/355 |
| 5,951,227 | A | 9/1999 | Calkins et al. | |
| 6,439,407 | B1 * | 8/2002 | Jacoff | B66C 13/06 212/272 |
| 8,496,279 | B2 * | 7/2013 | Aoki | B66C 13/08 294/82.15 |

FOREIGN PATENT DOCUMENTS

| | | | |
|---|---|---|---|
| JP | 2013-035651 | A | 2/2013 |
| WO | WO 01/70568 | A1 | 9/2001 |
| WO | WO 03/062042 | A1 | 7/2003 |
| WO | WO 2010/046649 | A1 | 4/2010 |
| WO | WO 2011/048480 | A1 | 4/2011 |
| WO | WO 2012/060715 | A1 | 5/2012 |

OTHER PUBLICATIONS

International Preliminary Report on Patentability, dated Aug. 30, 2016, issued in corresponding International Patent Application No. PCT/IB2015/000494. Total 6 pages.

United Kingdom Search Report, dated Sep. 4, 2014, issued in corresponding UK Patent Application No. GB1403298.1. Total 4 pages.

* cited by examiner

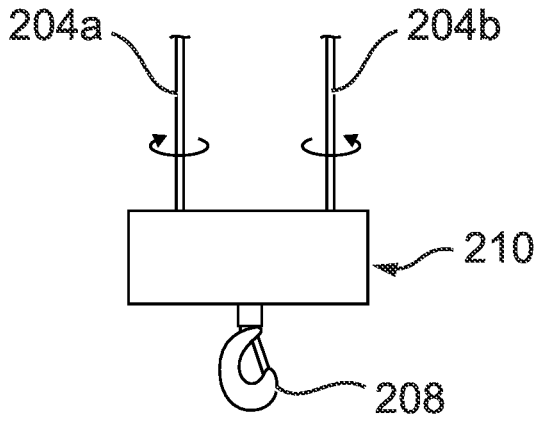
Fig. 6
Fig. 7b
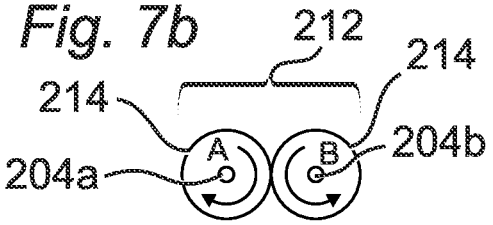
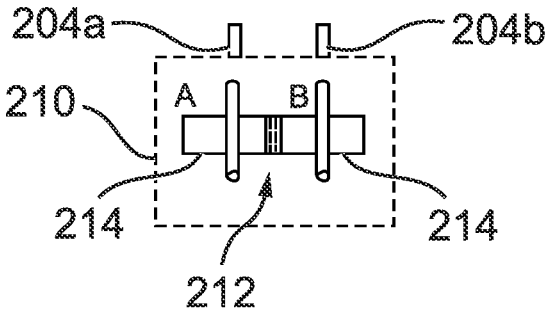
Fig. 7a

MULTI-CABLE SUBSEA LIFTING SYSTEM

CROSS-REFERENCE TO RELATED APPLICATIONS

The present application is a 35 U.S.C. §§ 371 national phase conversion of PCT/IB2015/000494, filed Feb. 24, 2015, which claims priority to United Kingdom Patent Application No. 1403298.1, filed Feb. 25, 2014, the contents of which are incorporated herein by reference. The PCT International Application was published in the English language.

TECHNICAL FIELD OF THE INVENTION

The present invention relates to a multi-cable subsea lifting system for raising and lowering loads in water, particularly deep water, as well as a subsea anti-cabling device and a method of raising or lowering a subsea load using the lifting system.

BACKGROUND OF THE INVENTION

The use of multi-cables to lift loads, either due to the increasing weight of the load, or increasing operating depth, or both, is known. Loads of hundreds of tonnes are no longer exceptional, typically often now over 400 tonnes.

Sometimes, multi-cable lifting systems are formed using a single looped cable as shown in EP0312336A. Sometimes, the equipment involves a number of separate cables, ropes, wires, etc., as shown for example in WO03/062042A1, U.S. Pat. No. 5,951,227 and WO2010/046649A1. Generally, the cables are provided from a reel, and optionally run through one or more drive mechanisms or winches to control their movement and loading.

"Cabling" is a phenomenon whereby imbalanced torsional characteristics of two cables, being used in 2-fall or parallel operation to lower or raise a load, can result in the cables axially rotating, causing the effective cable separation to decrease, and possibly resulting in rotational entanglement of the two cables employed. This can occur both in single cable hoist systems used in 2-fall configuration, as well as in parallel winch operations using cables of opposite hand lay.

Naturally, cabling is undesirable. It can even lead to situations where the integrity of the hoist cables is compromised, with damage resulting, or even overloading of a single wire. The required recovery of the cables can then be difficult, involving extensive OPEX including delay.

Meanwhile, there is an ever increasing drive to work at greater water depths, certainly beyond 1000 meters, and now commonly in excess of 2000 meters or even 3000 meters. The greater the required depth, the greater the extension of cables from their lifting platform or base, and the greater potential for cabling. Cabling at greater depths requires even greater OPEX.

WO2012/060715A1 shows a lifting tool for opposing twisting of generally submerged ropes, the lifting tool comprising a body with a centre axis and having a operable lock adapted to catch a rope connector, and a structure that is designed to be connected to a hoist or crane, wherein the lifting tool is equipped with at least one water flow inducing means positioned at a radial distance from the centre axis. Preferably, this includes rudders. WO2012/060715A1 is particularly concerned with hoisting operations at sea with heavy items, and where the hoisting operations are heave-compensated, such that the lifting rope will be continuously reeled in and out from a winch due to the heave motion of the lifting vessel. As it states, "an inherent problem when utilising parallel ropes is the tendency to twist and to get entangled in each other. As the ropes have to move independently of each other in the sea, an entanglement may in a worst case lead to cutting of the ropes and the loss of a valuable item."

SUMMARY OF THE INVENTION

An object of the present invention is to provide an improved multi-cable subsea lifting system which reduces or avoids cabling or twisting.

Thus, according to one aspect of the present invention, there is provided a multi-cable subsea lifting system comprising:

- two or more load-cable lifting apparatus;
- a load cable extending from each load-cable lifting apparatus to a subsea attachment point; and
- a torque measuring device associated with each load cable;
- one or more subsea anti-cabling devices, each anti-cabling device comprising a motor connected to a respective load cable; and
- a controller in communication with each motor and torque measuring device;

wherein the controller is configured to actuate each motor to impart a rotational force to its respective load cable in response to measurements obtained from the torque measuring device.

The anti-cabling device is able to maintain a defined distance or space between the cables by imparting a rotational force to the load cables to counter the torque experience by the load cables. Thus by means of the anti-cabling device in accordance with the invention, it is possible to limit cabling, remove cabling or control heading either automatically or from external control.

The load-cable lifting apparatus may be one or more units, mechanisms, apparatus etc. known in the art, including winches, winch assemblies, drive assemblies, traction control units, etc. and all of which are known in the art to be operable either singly or in parallel or serial combination. It or they are intended to provide control for the movement of the load cable, generally to and from a reel, and generally in and out of the water, optionally via one or more cranes or pulleys or other apparatus, units or mechanisms for deployment of load cables from an above sea position on a base or platform, such as on a vessel or unit on the sea surface.

Each load cable is also not limited in the present invention, and includes any form of wire, rope, cable, line etc., optionally being multi-stranded or otherwise formed, and generally for subsea lifting operations. Load cables are often steel wires, optionally stranded steel wires, but are increasingly being replaced by ropes, particularly fibre ropes, to reduce their weight for greater depth work.

The present invention is not limited by the number or nature of the load cables, or the number and nature of the load-cable lifting apparatus, which may be particularly adapted to suit the relevant load cable.

The load cables extend to a subsea attachment point for connection to the anti-cabling device(s).

In one embodiment of the present invention, the lifting system comprises a two or three load-cable lifting apparatus, and two or three load cables respectively extending to an attachment point for connection to an anti-cabling device.

The anti-cabling device comprises two or more spaced apart load-cable terminations for connection with a load cable, preferably with neighbouring load cables. The neighbouring load cables may be two parallel cables, such cables being separately provided. Alternatively, the neighbouring load cables may be three, four or more parallel cables, generally being parallel in the sense of from the water surface down to the attachment point.

The load-cable terminations of the anti-cabling device may be terminations that are locked axially, or integrated axial swivels that allow torsional release.

In exemplary embodiments, at least one load-cable termination comprises a wedge socket, socket-resin connection or spelter socket At least one motor may be directly or indirectly connected to its respective load cable.

In an exemplary embodiment, each motor is directly connected to its respective load cable. This may be achieved by any suitable means known in the art. For example, the motor may be directly connected to its respective load cable by an in-line connection between the drive shaft of the motor and a load-cable termination connecting the load cable to the anti-cabling device.

In alternative exemplary embodiment, at least one motor is indirectly connected to its respective load cable. This may be achieved by any suitable means known in the art. For example, gearing may be applied between the motor and the respective load cable.

The motors may be electrically or battery powered. Preferably, at least one motor is battery operated and the system comprises one or more batteries for powering each battery operated motor.

The lifting system may comprise at least one measuring device configured to measure the tension and torque characteristics of each load cable, and a processor adapted to process said measured tension and torque characteristic.

The at least one measuring device may comprise a load cell, accelerometer and/or gyroscope.

The load cell may be in the form of a tension or torsion load cell and may be introduced at or near the attachment point.

In exemplary embodiments wherein the at least one measuring device comprises an accelerometer and/or gyroscope, the controller may additionally be configured to actuate each motor to impart a rotational force to its respective load cable in response to measurements obtained from the accelerometer and/or gyroscope.

In an exemplary embodiment, the anti-cabling device is self-controlled or automated.

In an alternative exemplary embodiment, the anti-cabling device is driven by direct control or wireless control. For example, the anti-cabling device may be driven from a surface vessel, a remotely operated underwater vehicle or subsea communication device by direct or wireless control.

The anti-cabling device may comprise or include one or more of the embodiments or features discussed hereinbefore.

According to another aspect of the present invention, there is provided a method of raising or lowering a subsea load using the multi-cable subsea lifting system as defined herein, comprising at least the steps of:

(i) connecting the subsea anti-cabling device to the load cables at an attachment point;

(ii) connecting the load to a connector on the base of the anti-cabling device;

(iii) raising or lowering the load by extending or distending the load cables from the load-cable lifting apparatus;

(iv) actuating one or more motors to impart a rotational force to a respective load cable in response to measurements obtained from the respective torque measuring device.

In exemplary embodiments, a load-bearing sheave is used to connect the load to a connector on the base of the anti-cabling device.

The connector may instead be connectable to a subsea co-terminal loading point. The co-terminal loading point may be any device, unit or apparatus, or combination of same, intended to provide the interaction between the anti-cabling device and the load. Many tools, plates, pulleys or blocks, or combinations of same, are known in the art, and the present invention is not limited in this regard. A typical co-terminal load point is a triplate having two or more connection points along a top edge or surface, and a single, usually symmetrical or otherwise balanced, loading point at its lower edge or point.

The present invention provides the ability to maintain parallel spacing between subsea load cables, which allows the subsea lifting system to have increased cabling stability, either at existing depths, or at greater depths.

In particular, the present invention allows a user or operator to more frequently consider the use of multiple ropes or cables for lowering and recovering operations, where the use of multi-cables may have previously been thought of as at a disadvantage due to their expected cabling problems, compared with the use of a single wire or cable.

In a development of the present invention, there is provided a multi-cable subsea lifting system comprising:

two or more load-cable lifting apparatus;

a load cable extending from each load-cable lifting apparatus to a subsea attachment point; and one or more subsea anti-cabling devices, each anti-cabling device comprising a gear train connected to at least two of the load-cables.

Optionally, the or each gear train comprises two or more inter-operational gear wheels. Optionally, such gear wheels are directly or indirectly connected to the load cables; more optionally each load cable is connected, preferably directly connected, to a gear wheel.

Optionally, there are two or more anti-cabling devices in this development of the multi-cable subsea lifting system, each anti-cabling device being associated with two or more load-cables. Optionally, such anti-cabling devices are inter-operational, such that movement in the gear train of one anti-cabling device is related or affected by movement in the gear train of another anti-cabling device.

The use of a gear train as a subsea anti-cabling device provides inter-operational movement, generally rotational movement, between different load cables, particularly in response to movement, generally rotational movement, of one or more said load cables.

Movement of a load cable by the gear train may be passive, in the sense of only being as a reaction to or an effect by movement of another part of the gear train, in particular movement of one or more gear wheels in the gear train attached to one or more other load cables.

Optionally, rotational movement of one or more of the load cables by the gear train is partly, substantially, or fully driven by one or more motors, such as electrical motors or the like, known in the art. The or each motor could be operated and/or controlled by the use of a load cell or accelerometer and/or a gyroscope.

Optionally, this development of the present invention also includes a torque measuring device associated with at least one load cable, optionally all the load cables, and further optionally a controller in communication with the or each torque measuring device and the or each anti-cabling device as discussed herein.

As with the multi-cable subsea lifting system of the present invention discussed herein, this development of the present invention is also able to impart a rotational force to one or more the load cables to counter the torque experience by one or more of the other load cables. This achieves a balance in or a balance against any torsional twisting in the load cables.

This development of the present invention can involve a single set of gear wheels in a single gear train, or multiple sets of gear wheels in one or more gear trains; and optionally a complex mechanism with several pairs of gear trains, which can be self driven or power driven. Further, the or each gear train may involve one or more gear wheels which may be the same or different, achieving similar or varying gear ratios, which may depend upon the operating conditions of the lifting apparatus, the type of application, the type of loading (i.e. dynamic or static), the proposed deployment depth of the load, the area of operation, the water depth, the load cable characteristics (including diameter), the lifting appliance capacity, and the number of load cables used in parallel.

The load cables can be directly or indirectly connected to the anti-cabling device, and the load end termination can be a wedge socket or socket-resin connection, or secured eye, or with lock fittings, or gripping connection, or a combination of one or more of these, for connection to the load to be lifted or deployed, etc.

The development of the present invention is able to reduce the risk of cabling between two or more load cables, especially as torsional twist created in one load cable can be used to impart motion, in particular to provide a torque drive, into at least another generally neighbouring load cable, thereby providing a 'restoring torque' to the lifting system.

Preferably, this development of the present invention comprises a subsea anti-cabling device comprising a gear wheel connected laterally to each load cable, wherein each gear wheel is inter-operably connected to at least one other gear wheel, such that rotational motion of one load cable imparts opposite, preferably equal and opposite, rotational motion in at least one other load cable.

Optionally, the or each gear train of the or each anti-cabling device comprises one or more connectors, such as further gear wheels, between each gear wheel associated with a load cable. The skilled man is able to understand that the use of gears, gear wheels, cogs and the like, etc. allow ratios thereinbetween of inter-operable movement to be achieved for various reasons, in particular to impart different drives or movements thereinbetween.

According to another aspect of a development of the present invention, there is provided a method of raising or lowering a subsea load using the multi-cable subsea lifting system as defined herein, comprising at least the steps of:

(i) connecting the subsea anti-cabling device to the load cables at an attachment point;

(ii) connecting the load to a connector on the base of the anti-cabling device, each anti-cabling device comprising a gear train connected to at least two of the load-cables; and (iii) raising or lowering the load by extending or distending the load cables from the load-cable lifting apparatus.

Some or all of the embodiments described hereinabove in relation to the present invention apply equally to the aspects and embodiments of the development of the present invention described, such that the development of the present invention uses some or all of the embodiments of the present invention in the same or similar position, construction, arrangement, positioning etc., as described herein, and in the same or similar manner, in order to provide the same or similar benefit or effect.

BRIEF DESCRIPTION OF THE DRAWINGS

Embodiments of the present invention, and embodiments of the development of the present invention, will now be described by way of example only and with reference to the accompanying drawings in which:

FIG. 6 is a schematic view of a development of the anti-cabling device of the present invention;

FIGS. 7*a* and 7*b* are simplified side and top views inside the anti-cabling device of FIG. 6 showing a first gear train;

DESCRIPTION OF PREFERRED EMBODIMENTS

Figure 1:
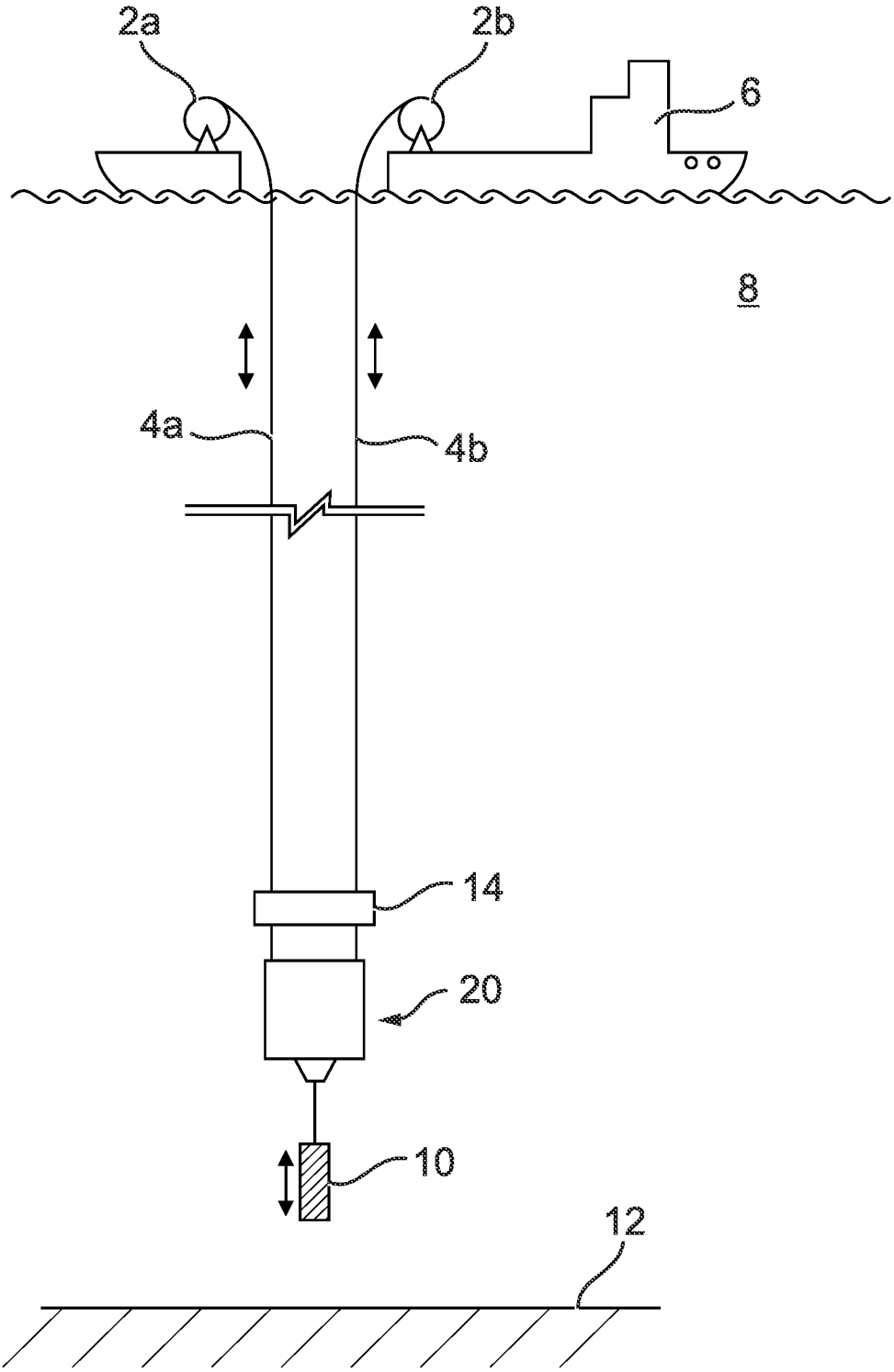
FIG. 1 is a schematic side view of a multi-cable subsea lifting system according to an embodiment of the present invention.

Referring to FIG. 1, a multi-cable subsea lifting system in accordance with the invention is shown. The lifting system comprises two load-cable lifting apparatus 2*a*, 2*b*, and two load cables 4*a*, 4*b* respectively extending from each load-lifting apparatus 2*a*, 2*b* to a subsea attachment point. The load-cable lifting apparatus 2*a*, 2*b* are located on a vessel 6, such as pipe laying service vessel or PLSV, on a sea 8.

Each load-cable lifting apparatus 2*a*, 2*b* could be a winch or sheave, generally able to provide control for the movement of the respective load-cable 4*a*, 4*b* through the sea 8 to raise and lift a load 10.

FIG. 1 also shows a seabed 12, which could be any distance below the surface of the sea 8, and towards which and optionally onto which it is desired to guide the load 10. However, the greater the subsea depth for location of the load 10, such as increasingly beyond 2000 or even 3000 meters, and the greater the actual load 10, such as being hundreds of tonnes, (increasingly up to or greater than 400 tonnes), then the greater is the desire to use multi-cable subsea lifting systems for obvious engineering reasons, compared with conventional single lifting cables or single cable lifting systems.

The load cables 4*a*, 4*b* in FIG. 1 can be provided from one or more reels (not shown) to the load-cable lifting apparatus 2*a*, 2*b* in a manner known in the art. The nature, design and operation of the load-cable lifting apparatus 2*a*, 2*b*, and the nature, design, etc. of the load cables 4*a*, 4*b*, are not limiting in the present invention, and can be those conventionally used and operated.

It will also be appreciated that FIG. 1 is a schematic drawing intended to show the present invention, and is not dimensionally accurate in relation to the relative sizes of the features shown. In particular, the distance between the load cables 4*a*, 4*b* could be any suitable distance, optionally based on or according to the load operation, the nature and number of the load cables etc., and possibly the load-lifting apparatus. For example, the distance between the load cables could be less than 1 m, 1 m, or greater than 1 m, such as 2 m, 3 m, 4 m, 5 m, or even more.

With a distance between the load cables of less than 1 m, or possibly only a few meters, it can be appreciated that, as the extent of the parallel winch operation is greater with increasing depth operation, the potential for cabling increases, where the load cables could move relative to one another, in particular, come closer to one another and even result in rotational entanglement.

Whilst this may seen more expectant for a two-cable subsea lifting system, the problem can occur also with multi-cable subsea lifting systems using more than two cables, especially where the lifting system may be divided into subsets or pairs of cables, each subset comprising closely spaced cables.

Thus, the present invention extends to aiming to relatively maintain a defined divide or distance or space between any two load cables in a multi-cable subsea lifting system.

Indeed, the present invention also extends to aiming to simultaneously relatively maintain the defined divide, distance or space between more than two cables, generally running in parallel operation, by extension of the subsea anti-cabling device imparting a rotational force to one or more of the load cables in response to and to counter the torque experienced by the load cable.

FIG. 1 shows the load cables 4*a*, 4*b* extending to a subsea attachment point. FIG. 1 also shows a measuring device in the form of a tension/torsion load cell 14 able to provide tension and torsion information to a monitor or control (not shown) to identify the on-going tension and torsion of each load cable 4*a*, 4*b* to an operator.

The system further comprises a subsea anti-cabling device 20 and a torque measuring device 22 associated with each load cable 4*a*, 4*b*.

Figure 2:
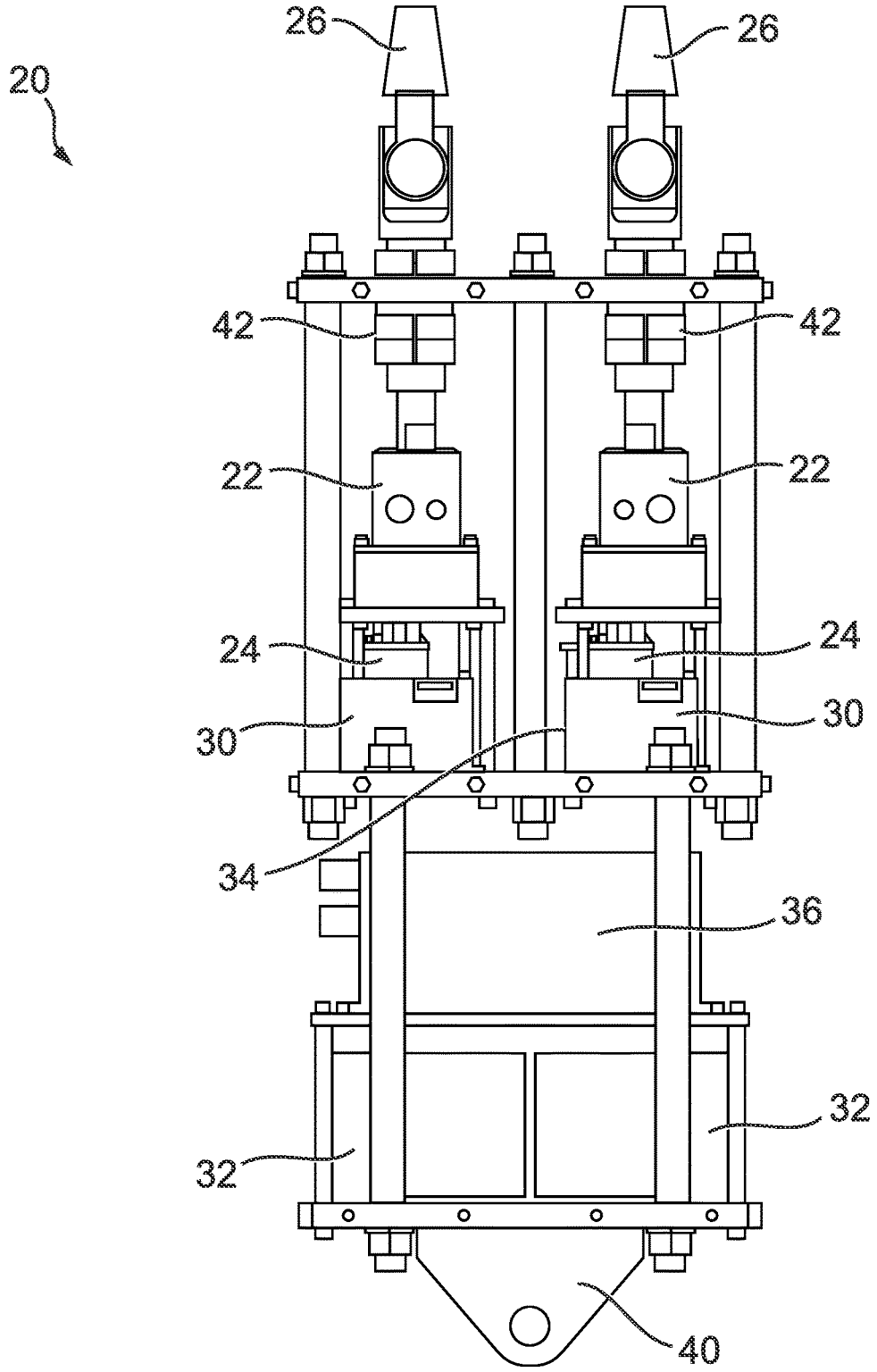
FIG. 2 is a side view of a first embodiment of a subsea anti-cabling device for use in the lifting system of FIG. 1.
Figure 3:
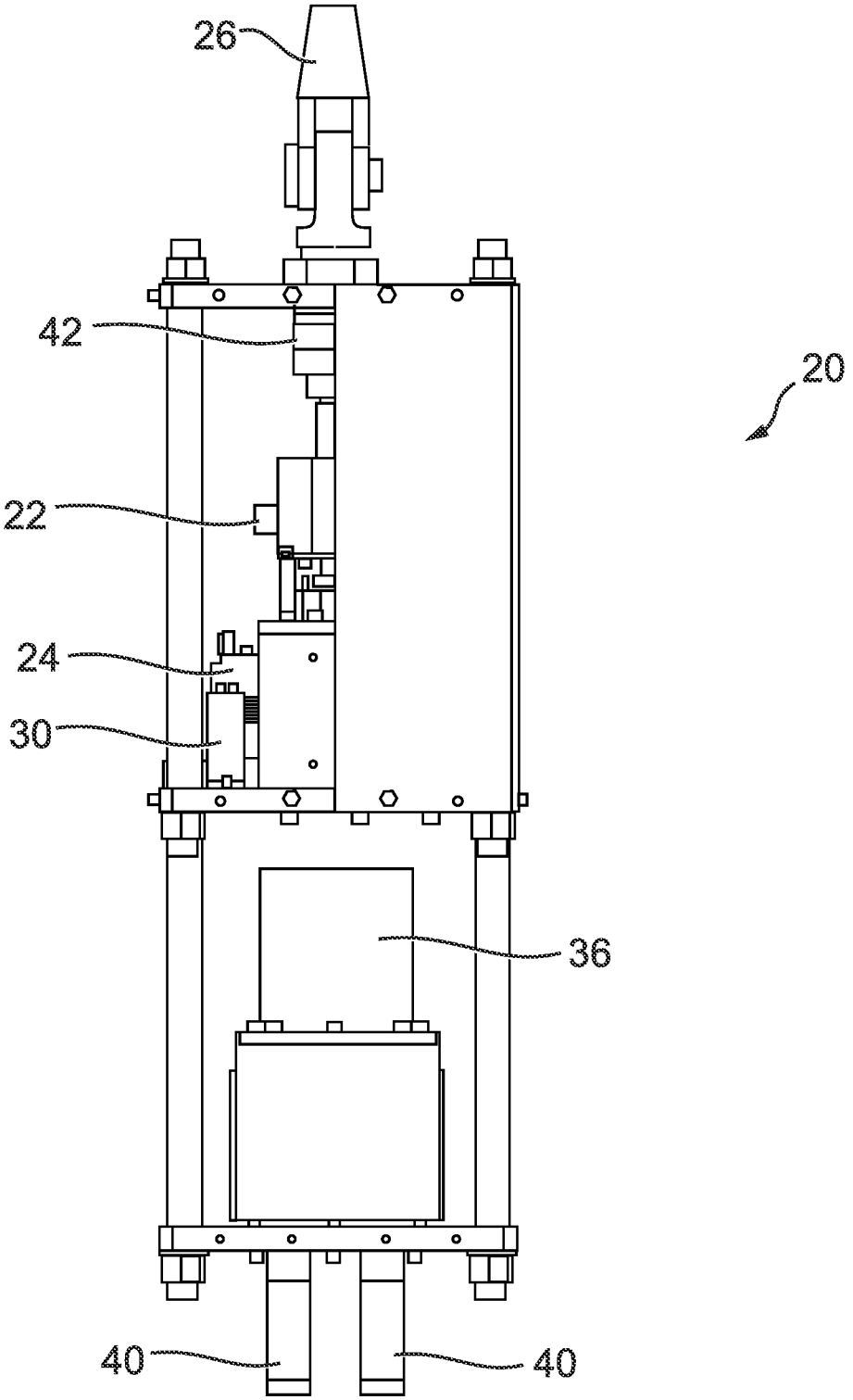
FIG. 3 is a front view of the anti-cabling device of FIG. 2.
Figure 4:
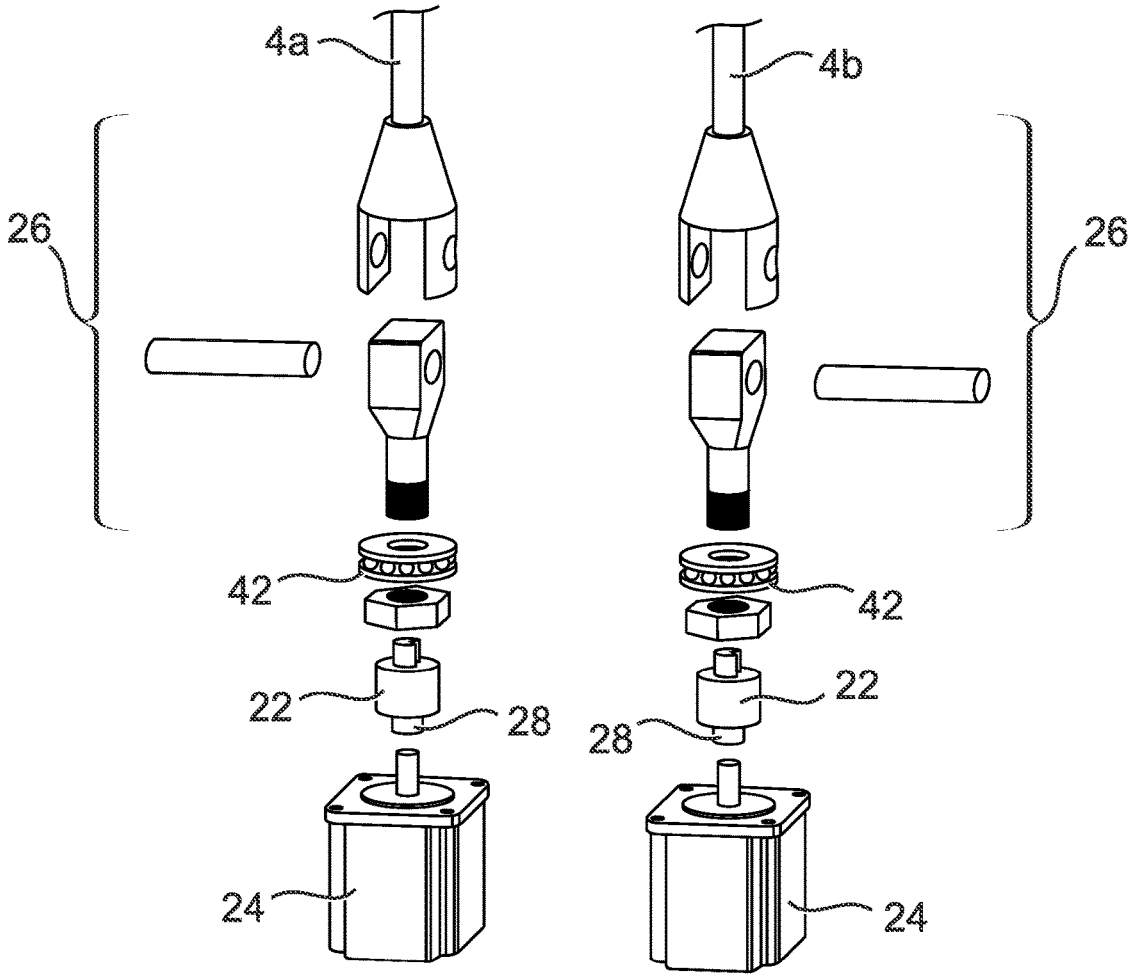
FIG. 4 is an exploded view of some of the components of the anti-cabling device of FIG. 2.

Referring to FIGS. 2 to 4, a first embodiment of a subsea anti-cabling device 20 for use in the lifting system in accordance with the invention is shown.

The anti-cabling device 20 is connected to the load cables 4*a*, 4*b* at the attachment point and comprises two or more load-cable terminations 26 for connection with a respective load cable 4*a*, 4*b*.

The load-cable terminations 26 may be in any suitable form for connecting the load cables 4*a*, 4*b* to the anti-cabling device 20. For example, the load-cable terminations 26 may comprise a wedge socket, socket-resin connection or spelter socket. In the embodiment shown, the load-cable terminations 26 are in the form of a spelter socket.

In the embodiment shown, the anti-cabling device 20 comprises a symmetrical arrangement for each load cable 4*a*, 4*b* deployed in parallel.

The anti-cabling device 20 comprises a motor 24 connected to a respective load-cable 4*a*, 4*b*. The motor 24 may be any suitable motor capable of imparting a rotational force to the respective load cable 4*a*, 4*b*. In the embodiment shown, the motor 24 is in the form of a stepper motor.

Each stepper motor 24 is battery operated and the lifting system comprises one or more batteries 32 for powering the stepper motors 24. In the embodiment shown, each stepper motor 24 is powered by its own battery 32 which is housed within the anti-cabling device. While the motors 24 are shown as being battery operated, it would be understood that the motors may instead be electrically operated or operated by a different power source.

Each motor 24 is directly connected to the load-cable termination 26, and hence the respective load cable 4*a*, 4*b*, via a shaft 28 (see FIG. 4). It would be understood that each or one of the motors 24 may be indirectly connected to a respective load cable 4*a*, 4*b* by suitable means.

The torque measuring device 22 is in the form of a torque sensor which comprises a rotating disc encoder. The torque sensor 22 is mounted on the shaft 28 and a thrust bearing 42 is positioned between the torque sensor 22 and the load-cable termination 26.

The system further comprises a controller 30 in communication with each motor 24 and torque sensor 22. The controller 30 is configured to actuate each motor 24 to impart a rotational force to its respective load cable 4*a*, 4*b* in response to measurements obtained from the torque sensor 22.

A processor 34 is provided which is adapted to process the measured tension and torque characteristics of each load-cable 4*a*, 4*b*. The tension and torque characteristics of each load-cable 4*a*, 4*b* may be determined via the load cell 14 and/or at least one auxiliary measuring device configured to measure the tension and torque characteristics of each load-cable 4*a*, 4*b*. The auxiliary measuring device(s) may be in the form of a second load cell arrangement, accelerometer and or gyroscope.

In the embodiment shown, the system comprises an auxiliary measuring device in the form of a gyroscope 36.

The gyroscope 36 is configured to continuously feed heading and/or orientation data to the processor 34.

The processor 34 is operably linked to the controller 30 and torque sensor 22, and the amount of rotational force imparted by the motor(s) will be determined by the controller 30 based on feedback/information received from the processor 34.

The components of the anti-cabling device 20 associated with a load cable 4*a*, 4*b*, i.e. processors 34, controller 30, auxiliary measuring device etc., are in communication with the components associated with another load cable 4*a*, 4*b*. The connection between the components may be a wireless connection or a wired connection.

The anti-cabling device 20 comprises a connector in the form of a pair of base plates 40 depending from the base thereof to facilitate the connection of the load 10 to the anti-cabling device 20.

The lifting system may be configured such that the anti-cabling device 20 is self-controlled or automated by incorporating a software run by the processor 34 which determines the permitted tension and/or torsion tolerances experienced by the load cables 4*a*, 4*b* and when the controller 30 can activate/deactivate the motor(s).

Alternatively or in addition, the anti-cabling device 20 may be driven by direct control or wireless control. In such an arrangement where the anti-cabling device 20 is driven by direct control or wireless control, the anti-cabling device 20 may be driven from a surface vessel, a remotely operated underwater vehicle or subsea communication device.

In such an arrangement, information about the subsea lifting system can be provided to a control or monitor via one or more video links, such as from one or more ROVs (not shown), to assist with the activation of the anti-cabling device 20 in response to excessive torsion being experience by one or more of the load cables 4*a*, 4*b*. Data from the processor 34 will be transmitted to the control or monitor via a suitable link, for example a wireless link. The link is preferably a two way link such that any commands sent to the processor 34 from the control or monitor are sent through the same link.

With increasing extension or depth of the load cables 4*a*, 4*b*, and possibly based on sea conditions both above the surface of the sea 8, (such as the heave of the vessel 6) and in the sea 8, the possible or expected locations or areas of the risk of cabling may be known or identifiable or otherwise predicable. Additionally or alternatively, monitoring of the status of the tension and/or torsion of the load cables 4*a*, 4*b*, through the load cell 14, auxiliary measuring devices, or one or more other monitors, including visual monitors from for example ROVs, can indicate locations or areas of risk of cabling during the operation of the lifting system.

Thus, it is possible for the user or operator of the subsea lifting system to activate the anti-cabling device 20 when the onset of cabling is identified and monitor the effect of the anti-cabling device 20 in reducing the possibility of cabling occurring.

Figure 5:
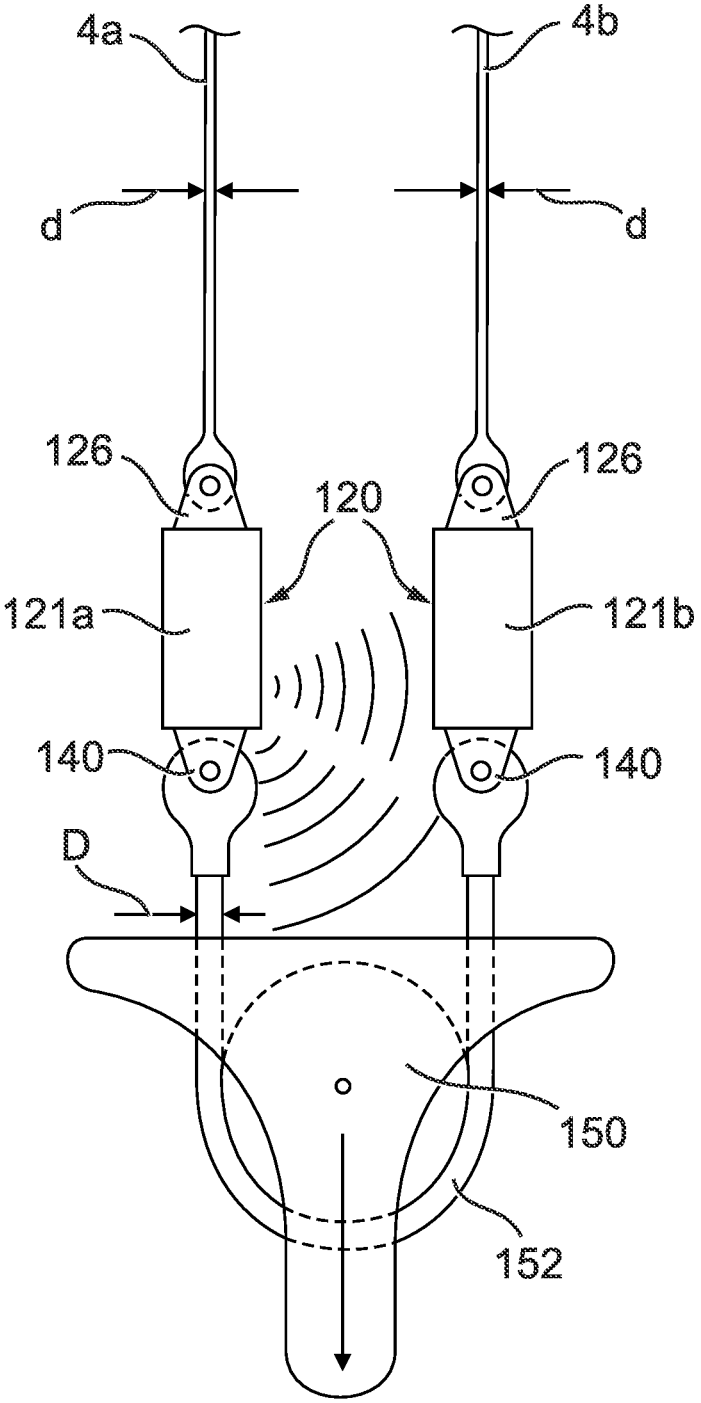
FIG. 5 is a schematic view of a second embodiment of an anti-cabling device in accordance with the invention depicting the connection of a load-bearing sheave to the base thereof.

Referring to FIG. 5, a second embodiment of a anti-cabling device 120 in accordance with the invention is shown. The reference numerals for similar features of the second embodiment to those of the first embodiment have been increased by 100 for convenience, while the same reference numerals have been used for identical features. For example, the load terminations which were indicated by the reference numeral 26 in the first embodiment are now indicated by the reference numeral 126.

The embodiment differs from the previously describe embodiment in that rather than having the components of the anti-cabling device 120 associated with each load cable 4*a*, 4*b* housed in the same housing, the components are housed in separate housings. In the embodiment shown, the anti-cabling device 120 comprises two parts 121*a*, 121*b*, each part comprising the components associated with a respective load cable 4*a*, 4*b*.

FIG. 5 also depicts a way of connecting the load 10 to the anti-cabling device 120.

In the embodiment shown, the load 10 (not shown) is connected to the anti-cabling device 120 by way of a load-bearing sheave 150. The load-bearing sheave 150 has the advantage in that it mechanically ensures load balance is maintained between the two parts 121*a*, 121*b* of the anti-cabling device 120. Each part 121*a*, 121*b* of the anti-cabling device 120 being associated with a respect load cable 4*a*, 4*b*.

Each part 121*a*, 121*b* of the anti-cabling device 120 comprises a connector having at least one base plate 140 depending from the base the anti-cabling device 120. The load-bearing sheave 150 is connected to the at least one base plate 140 by means of a wire rope 152 from which the load-bearing sheave 150 is suspended. The wire rope 152 comprises a diameter D that is greater than the diameter d of the load cables 4*a*, 4*b*. In this way, any torsion applied by the anti-cabling devices 120 will be passed onto the smaller diameter load cables 4*a*, 4*b*.

The orientation and distance of the parts 121*a*, 121*b* of the anti-cabling device 120 relative to the load-balancing sheave 150 is determined by the auxiliary measuring device and communicated between the parts 121*a*, 121*b*. The depicted embodiment shows the communication in the form of a wireless communication.

In order to raise or lower a subsea load 10 using the multi-cable subsea lifting system in accordance with the invention, a user or operator has to preform at least the steps of:

(i) connecting the subsea anti-cabling device 20, 120 to the load cables 4*a*, 4*b* at the attachment point;

(ii) connecting the load 10 to a connector 40, 140 on the base of the anti-cabling device 20, 120;

(iii) raising or lowering the load 10 by extending or distending the load cables 4*a*, 4*b* from the load-cable lifting apparatus 2*a*, 2*b;*

(iv) actuating one or more motors 24 to impart a rotational force to a respective load cable 4*a*, 4*b* in response to measurements obtained from the respective torque measuring device 22.

FIG. 6 shows a development of the present invention to provide a multi-cable subsea lifting system comprising two load-cable lifting apparatus (not shown, but optionally the same or similar to those shown in FIG. 1); a load cable 204*a*, 204*b* extending from each load-cable lifting apparatus to a subsea load attachment point 208; and a subsea anti-cabling device 210.

Parts of the subsea anti-cabling device 210 in FIG. 6 are shown in FIGS. 7*a* and 7*b*. It comprises a gear train 212 comprising gear wheels 214 labelled A and B attached to and symmetrically connected to each load cable 204*a*, 204*b* respectively, wherein the gear wheels 214 are inter-operably connected so that movement of one will provide or affect movement of the other. The load cables 204*a*, 204*b* and the gear wheels 214 can be connected by the same connection means as described previously for the connection between the load cables 4*a*, 4*b* and the motor 24, such as a load-cable terminations FIG. 7*b* in particular shows that following rotational motion of, for example, the load cable 204*a*, the inter-operability of the gear wheel A results in opposite rotational motion of the other gear wheel B, and thereby of the second load cable 204*b*, in an equal and opposite direction, assuming that the gear size or ratio, etc. of the gear wheels 214 is the same. Torsional balance is therefore achieved between the load cables 204*a*, 204*b*.

Figure 8B:
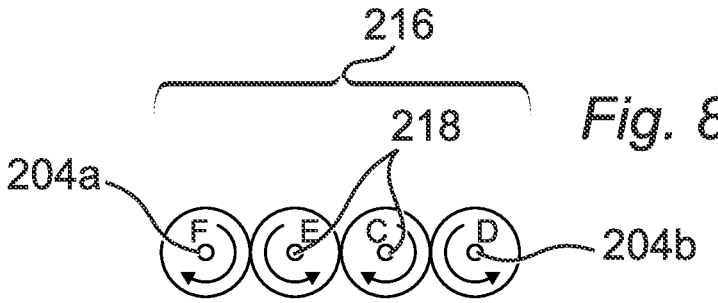
FIGS. 8*a* and 8*b* are simplified side and top views inside another anti-cabling device according to this development of the present invention.
Figure 8A:
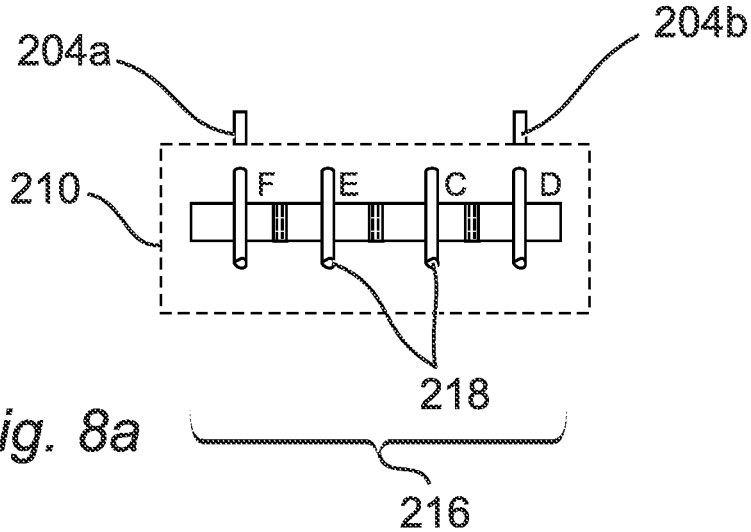

FIGS. 8*a* and 8*b* show the internal working of an alternative arrangement in the subsea anti-cabling device 210, comprising a gear train 216 having two outer gear wheels labelled F and D attached to each of the load cables 204*a*, 204*b* respectively, and two intermediate gear wheels labelled E and C, able to rotate on their own axes 218, such that rotational movement of one outer gear wheel F (due to torque in load cable 204*a*) can still impart drive through the gear train 216 to the other outer gear wheel D to produce the same rotational effect as shown in FIG. 7*b*, without direct connection between the outer gear wheels F and D.

Figure 9:
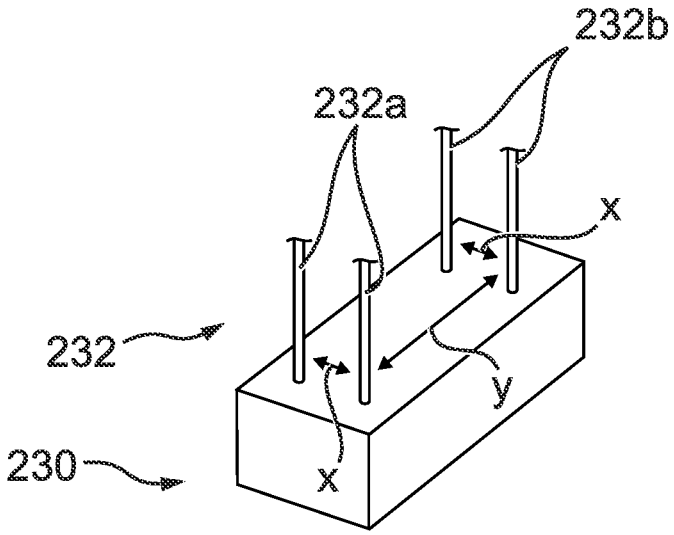
FIG. 9 is a perspective view of another anti-cabling device from FIG. 6.

FIG. 9 shows a further alternative subsea anti-cabling device 230 having four load cables 232, which may be based on two parallel load cables 232*a* derived from one lifting apparatus (not shown), and two parallel load cables 232*b* derived from a second lifting apparatus (not shown). Such a load cable lifting arrangement is known in the art. FIG. 9 shows developing a gear train based on inter-operability between either (i) each of the sets (x) of parallel cables 232*a*, 232*b* for each lifting apparatus, thereby using two gear trains and/or two anti-cabling devices, or (ii) by connection of two or more gear trains through an intermediate arrangement (y), such as that shown in FIGS. 8*a* and 8*b*, or (iii) the complete inter-operability of all the gear wheels connected to each of the loads cables 232. Each of these arrangements provides inter-cable rotational drive, which drive may be controlled by one or more controllers (not shown) either directly or indirectly connected to the load cables 232, and optionally based on the provision of one or more load cable rotation measurement devices (not shown) such as torque meters and the like.

The development of the present invention as described in relation to FIGS. 6-9 provides the same benefits and advantages as described hereinbefore for the present invention, and again in particular for lifting apparatus involved at increased depth capacity for parallel winch operations. The development of the present invention provides use of an anti-cabling device which reduces the risk of cabling for parallel wire rope applications, in particular for lowering and recovery operations. The development may be self controlled (passive) or automated by use of a load cell, etc, with appropriate electronics capable of measuring, capturing, post-processing and/or responding to real time tension and torque characteristics of each load cable, either individually or cumulatively.

The skilled man can understand the application of some or all of the embodiments described hereinabove in relation to the present invention apply equally to embodiments of the development of the present invention described, such that the development of the present invention uses some or all of the embodiments of the present invention, in the same or similar position, construction, arrangement, positioning etc., as described herein, and in the same or similar manner, in order to provide the same or similar benefit or effect. The present invention provides a subsea anti-cabling device able to be deployed in a multi-cable subsea lifting system to reduce the risk of cabling. In particular, the anti-cabling device can be positioned between the load cables and load to counter any torque experienced by the load cables. This increases the competitive advantage of the use of multi-cable lifting systems compared with single cable lifting systems, and thus their commercial applicability to use at increasing depth capacity for parallel winch operations. In particular, it can provide the user or operator with greater confidence of the use of multi-cable subsea lifting systems at greater depths, by aiming to reduce or even avoid completely one of a disadvantage associated with multi-cable subsea lifting systems.

While a number of components of the lifting system have been shown incorporated in the anti-cabling device, it should be understood that they may be positioned at different locations within the lifting system.

Furthermore, the controller may be configured to actuate each motor to impart a rotational force to its respective load cable in response to measurement obtained from the accelerometer and/or gyroscope or other heading instrumentation.

While the multi-cable subsea lifting system has been described with two subsea anti-cabling devices, each connected to a load cable, it should be understood that it is not limited thereto. For example, the lifting system may comprise a single anti-cabling device or the lifting system may comprise a first anti-cabling device connected to the load cable as described above with a second anti-cabling device directly connected to another device such a spreader beam or balancing sheave etc.

Various modifications and variations to the described embodiments of the invention will be apparent to those skilled in the art without departing from the scope of the invention as defined herein. Although the invention has been described in connection with specific preferred embodiments it should be understood that the invention as defined herein should not be unduly limited to such specific embodiments.

The invention claimed is:

1. A multi-cable subsea lifting system comprising:

two or more load-cable lifting apparatus;

a load cable extending from each load-cable lifting apparatus to a subsea attachment point;

a torque measuring device configured to detect a twisting of a load cable;

one or more subsea anti-cabling devices, each anti-cabling device comprising a motor connected to a respective load cable; and a controller in communication with each motor and torque measuring device; wherein the controller is configured to actuate each motor to impart a rotational force to its respective load cable in response to measurements obtained from the torque measuring device.

2. A lifting system as claimed in claim 1, wherein each anti-cabling device comprises two or more load-cable terminations for connection with a load cable.

3. A lifting system as claimed in claim 2, wherein the load-cable terminations comprise a wedge socket, socket-resin connection or spelter socket.

4. A lifting system as claimed in claim 1, wherein at least one motor is directly connected to its respective load cable.

5. A lifting system as claimed in claim 4, wherein each motor is directly connected to its respective load cable.

6. A lifting system as claimed in claim 1, wherein each motor is indirectly connected to its respective load cable.

7. A lifting system as claimed claim 1, wherein at least one motor is battery operated and the lifting system comprises one or more batteries for powering each battery operated motor.

8. A lifting system as claimed in claim 1, wherein the lifting system comprises at least one measuring device configured to measure the tension and/or torque characteristics of each load cable, and a processor adapted to process said measured tension and/or torque characteristic.

9. A lifting system as claimed in claim 8, wherein the at least one measuring device comprises a load cell, accelerometer and/or gyroscope.

10. A lifting system as claimed in claim 9, wherein the controller is configured to actuate each motor to impart a rotational force to its respective load cable in response to measurement obtained from the accelerometer and/or gyroscope.

11. A lifting system as claimed in claim 1, wherein the anti-cabling device is self-controlled or automated.

12. A lifting system as claimed in claim 1, wherein the anti-cabling device is driven by direct control or wireless control.

13. A lifting system as claimed in claim 12, wherein the anti-cabling device is driven from a surface vessel, a remotely operated underwater vehicle or subsea communication device.

14. A method comprising:

(i) providing the multi-cable subsea lifting system as claimed in claim 1;

(ii) connecting the subsea anti-cabling device to the load cables at an attachment point;

(iii) connecting the load to a connector on the base of the anti-cabling device;

(iv) raising or lowering the load by extending or distending the load cables from the load-cable lifting apparatus;

(v) actuating one or more motors to impart a rotational force to a respective load cable in response to measurements obtained from the respective torque measuring device.

15. A method as claimed in claim 14, wherein a load-balancing sheave is used to connect the load to a connector on the base of the anti-cabling device.

16. The lifting system as claimed in claim 1, wherein the one or more anti-cabling devices are positioned at the subsea attachment point, the subsea attachment point being configured to attach to a load to be lifted by the subsea lifting system.

17. The lifting system as claimed in claim 1, wherein the torque measuring device is positioned subsea.

18. The lifting system as claimed in claim 1, wherein the rotational force rotates its respective load cable with respect to a longitudinal axis of the load cable.

19. The lifting system as claimed in claim 1, wherein the rotational force rotates the load cable counter to the twisting of the load cable detected.

* * * * *